United States Patent [19]

Sakaki et al.

[11] 4,173,252

[45] Nov. 6, 1979

[54] SEAL FOR A ROTARY REGENERATIVE HEAT EXCHANGER

[75] Inventors: Yoshihiro Sakaki, Yokohama; Kensuke Eishima, Urawa, both of Japan

[73] Assignee: Nissan Motor Co., Ltd., Yokohama, Japan

[21] Appl. No.: 835,300

[22] Filed: Sep. 21, 1977

Related U.S. Application Data

[63] Continuation of Ser. No. 413,528, Nov. 7, 1973, abandoned.

[30] Foreign Application Priority Data

Nov. 20, 1972 [JP] Japan ..... 47-132634
Nov. 20, 1972 [JP] Japan ..... 47-132635

[51] Int. Cl.[2] ..... F28D 19/00

[52] U.S. Cl. ..... 165/9; 277/83; 277/53

[58] Field of Search ..... 165/9; 277/53, 83

[56] References Cited

U.S. PATENT DOCUMENTS

| | | | |
|---|---|---|---|
| 2,740,614 | 4/1956 | Hammond et al. | 165/9 |
| 3,301,317 | 1/1967 | Weaving et al. | 165/9 X |
| 3,559,725 | 2/1971 | Fucinari et al. | 165/9 X |
| 3,650,317 | 3/1972 | Barnard et al. | 165/9 |
| 3,692,097 | 9/1972 | Penny | 165/9 |
| 3,780,791 | 12/1973 | Barnard et al. | 165/9 |

FOREIGN PATENT DOCUMENTS

| | | | |
|---|---|---|---|
| 1206246 | 6/1968 | United Kingdom | 165/8 |

*Primary Examiner*—Albert W. Davis, Jr.

[57] ABSTRACT

A seal comprising a bellows and a shielding plate. The bellows extending from an interior wall of a housing and surrounding a fluid flow passage urges a shoe into sealing contact with an end face of a wheel type heat accumulator. The shielding plate inside the bellows protects the bellows from thermal variations.

1 Claim, 6 Drawing Figures

SEAL FOR A ROTARY REGENERATIVE HEAT EXCHANGER

This is a continuation of application Ser. No. 413,528, filed Nov. 7, 1973, now abandoned.

BACKGROUND OF THE INVENTION

The present invention relates to a seal for a rotary regenerative heat exchanger having a disc type heat accumulator seal and assembly therefore.

Rotary regenerative heat exchangers commonly comprise a housing accommodating therein a disc type heat accumulator containing heat storing material and permitting flow of fluid therethrough from end face to end face. The housing has two fluid stream passages within it; one for hot fluid and another for cold fluid. As the heat accumulator rotates, each section of it passes alternately from a hot fluid stream passage, in which it absorbs heat to a cold fluid stream passage in which it gives up heat to a relatively cold fluid passing through the heat accumulator in the opposite direction. Hot and cold fluids are prevented from mixing with each other by shoes which slidingly and sealingly engage with the end faces of the disc and are mounted on the housing.

Various seals have been used to improve sealing of rotary regenerative heat exchangers including the use of bellows to compensate for relative movement between the shoe and the housing. In this type of seal a thin bellows, a thick shoe and a thick mounting plate are interconnected by welding. The seal thus constructed is mounted in the housing by securing the mouting plate thereto such that the shoe will slidingly contact with the disc type heat accumulator. With this seal, however, upon abrupt temperature variation of the fluid to which the seal is exposed, welded portions either between the mounting plate and the bellows or between the bellows and the shoe are apt to break since the thermal expansion and contraction significantly differs between the thin bellows and the thick shoe and mounting plate. To alleviate this drawback of the prior art mentioned above, there has been proposed a seal which comprises a thin bellows welded at both ends to plates of medium thickness welded to a thick mounting plate and a shoe, respectively. This prior art is not, however, a solution to the drawback mentioned above since the welded portions are not free from breakage when subjected to abrupt temperature variation.

SUMMARY OF THE INVENTION

It is accordingly an object of the present invention to provide a rotary regenerative heat exchanger, has eliminated the above mentioned drawback.

It is another object of the present invention to provide a rotary regenerative heat exchanger having a seal assembly which is designed to prevent temperature variations of fluid from being transmitted rapidly to welded portions thereof.

It is still another object of the present invention to provide a rotary regenerative heat exchanger, wherein a bellows of a seal assembly is connected to a mounting plate and a shoe without welding.

BRIEF DESCRIPTION OF THE DRAWINGS

The above objects, features and advantages of the present invention will become apparent from the following description taken in conjunction with the accompanying drawings, wherein.

DETAILED DESCRIPTION OF THE INVENTION

Figure 1:
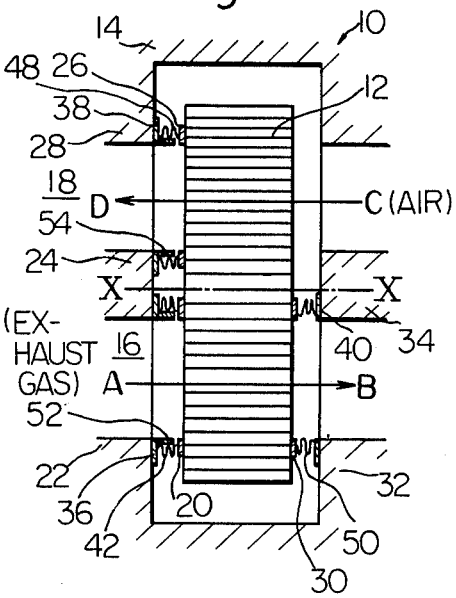
FIG. 1 is a vertical sectional diagrammatic view of a rotary regenerative heat exchanger according to the present invention.

Referring to FIG. 1, a rotary regenerative heat exchanger 10 is provided with a disc type rotary heat accumulator 12, which is mounted for rotation about an axis X—X within a housing 14. The housing has two passages through it; one passage 16 for high temperature exhaust gas flow under low pressure, and another passage 18 for cold air flow under high pressure.

A shoe 20 located between the heat accumulator 12 and walls 22 and 24 surrounds the upstream end of the passage 16 and slidingly and sealingly engages with an end face of the heat accumulator 12. A similar shoe 26 is located between the heat accumulator 12 and walls 24 and 28 and surrounds the passage 18. A third shoe 30 is located between the heat accumulator 12 and walls 32 and 34 and surrounds the downstream end of the passage 16.

A mounting plate 36 surrounding the passage 16 is secured to the walls 22 and 24. A similar mounting plate 38 surrounding the passage 18 is secured to the walls 24 and 28. A third mounting plate 40 surrounds the passage 16.

Figure 2:
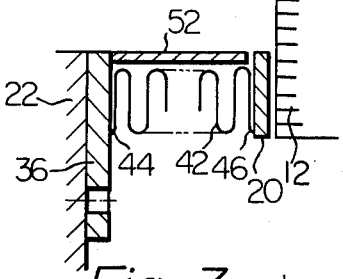
FIG. 2 is an enlarged partial sectional diagrammatic view of FIG. 1 and shows one embodiment of the present invention.

A shielding plate 52 extends from the inner peripheral portion of the mounting plate 36 axially toward the shoe 20. The inner radial surface of the shielding plate 52 surrounds the passage 16. The shielding plate 52 and the shoe 20 are not connected together and provide a gap therebetween, as best seen in FIG. 2. The gap should be within a range from 2 to 3 mm. A similar shielding plate 54 extends from the mounting plate 38 in a same manner, and surrounds the passage 18.

A bellows 42 positioned between the mounting plate 36 and the shoe 20 is at one axial end 44 thereof welded to the mounting plate 36 and at the other axial end 46 thereof to the shoe 20 (see FIG. 2), and urges the shoe 20 against the end of the heat accumulator 12. The bellows 42 extending from the mounting plate 36 to the shoe 20 surrounds the shielding plate 52. A similar bellows 48 is welded to the mounting plate 38 and the shoe 26 and surrounds the shielding plate 54. A third bellows 50 is welded to the mounting plate 40 and the shoe 30. Thus, the shoes 20, 26 and 30 are prevented from rotation with the heat accumulator 12.

When the heat exchanger 10 is operating, high pressure air from a compressor of a gas turbine (not shown) passes through the passage 18 of the heat accumulator 12 in the direction of an arrow C–D. The air is fed from the passage 18 to a gas turbine burner and turbine wheel (not shown). Low pressure exhaust gas from the turbine wheel passes through the passage 16 in the direction of an arrow A–B.

As the heat accumulator 12 rotates, it absorbs heat from exhaust gas in the passage 16 and transfers it to air in the passage 18.

Heat in the passage 16 is prevented from being directly transferred to the bellows 42 because the bellows 42 is shielded by the shielding plate 52. Similarly, the bellows 48 is shielded by the shielding plate 54 from heat in the passage 18.

As has thus far been described, the seals can allow variations in temperature in the adjacent passages without abruptly subjecting the welded portions to the influence of the temperature variations. It will thus be appreciated that the welded portions can be protected against breakage even during temperature variation in the passages.

Figure 3:
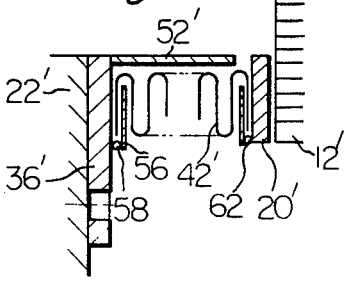
FIG. 3 is a similar view to FIG. 2 and shows another embodiment of the present invention.
Figure 4:
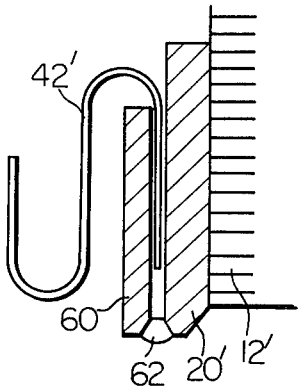
FIG. 4 is an enlarged partial sectional view of FIG. 3.

Referring now to the embodiment of FIG. 3, a retainer plate 56 is welded at an end 58 thereof to a mounting plate 36' to provide a groove with its opening facing radially inward. A similar retainer plate 60 is welded to a shoe 20' at an end 62 thereof to provide a groove with its opening facing radially inward. Axial ends of a bellows 42' are fitted loosely in the grooves, as best seen in FIG. 4. Preferably the thickness of the retainer plates 56 and 60 should be relatively great to increase the strength of the welds to the mounting plate 36' and shoe 20' respectively. With the seal illustrated in FIGS. 3 and 4, even if the bellows 42' thermally expands appreciably, such thermal expansion can be well compensated for since the bellows 42 is loosely connected to the plate 36' and shoe 20'. Although the seal illustrated in FIGS. 3 and 4 has clearances between the grooves and the ends of the bellows 42' positioned in the grooves, the amount of leakage of fluid through these clearances has been found in practice to be negligible because of a so called labyrenth seal produced thereby.

Figure 5:
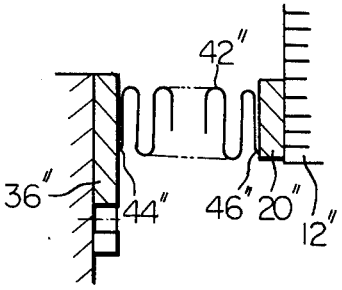
Fig. 5 PRIOR ART
FIGS. 5 and 6 illustrate prior art seals presented in the foregoing description.
Figure 6:
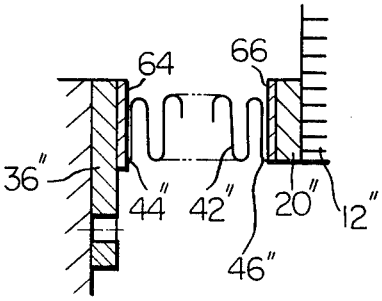
Fig. 6 PRIOR ART

FIGS. 5 and 6 show typical examples of prior art seals described in the foregoing. In the prior art seal of FIG. 5, a bellows 42" is welded to a mounting plate 36" and to a shoe 20" at ends 44" and 46", respectively. In another prior art seal of FIG. 6, a plate 64 of medium thickness is welded to a mounting plate 36", and a similar plate 66 to a shoe 20". A bellows 42" is welded to the plates 64 and 66 at ends 44" and 46" respectively.

What is claimed is:

1. In a rotary regenerative heat exchanger:

a housing having first, second and third annular grooves formed therein;

a disc type heat accumulator rotatable within said housing and through which a hot fluid stream flows from a first axial face to a second axial face and cold fluid stream flows from said second axial face to said first axial face, said accumulator being disposed in said housing so that said first and second annular grooves are juxtaposed with said first axial face and said third annular groove juxtaposed with said second axial face;

first, second and third annular sealing shoes, said first and second shoes being disposed in rubbing contact with said first axial face and said third shoe being in rubbing contact with said second axial face, said first, second and third shoes each having an annular groove formed therein;

a first corrugated annular member formed with a plurality of corrugations along the longitudinal length thereof, said first annular member having first and second end portions respectively slidably received in said first annular groove and said annular groove formed in said first shoe in a manner that the thermal expansion of said first annular member can be compensated for and the spaces defined on either side of said end portions in said annular grooves are such that a labyrinth seal effect is produced;

a first annular shield fixedly mounted on said housing at a location juxtaposed with said first annular groove and which extends within said first annular member toward said first axial surface to juxtapose said shoe and define an annular space therebetween so that hot fluid flowing to said first axial face and through said accumulator to said second axial face cannot directly impinge on said first annular member;

a second corrugated annular member formed with a plurality of corrugations along the longitudinal length thereof, said second member having first and second end portions respectively slidably received in said second annular recess and said recess formed in said second shoe so that the thermal expansion of said second annular member can be compensated for and the spaces defined on either side of said end portions in said annular grooves are such that a labyrinth seal effect is produced;

a second annular shield fixedly mounted to said housing at a location juxtaposed with said second annular groove and which extends toward said first axial face to juxtapose said second shoe to define an annular space therebetween so that said cold stream passing from said second axial face through said accumulator to said first axial face and which flows from said first axial face in a heated state having received heat from said accumulator cannot impinge directly on said second annular member; and a third corrugated annular member formed with a plurality of corrugations along the longitudinal length thereof, said third annular member having first and second end portions respectively slidably received in said third annular groove and said groove formed in said third shoe in a manner such that the thermal expansion of said third annular member can be compensated for and the space defined on either side of said end portions received in said recesses are such that a labyrinth seal effect is produced.

* * * * *